US010052742B2

(12) United States Patent
Fukazawa et al.

(10) Patent No.: US 10,052,742 B2
(45) Date of Patent: Aug. 21, 2018

(54) GRINDING WHEEL

(71) Applicant: DISCO CORPORATION, Tokyo (JP)

(72) Inventors: Takashi Fukazawa, Tokyo (JP); Mitsuhiro Nomura, Tokyo (JP); Suguru Hiraiwa, Tokyo (JP); Toyohiro Komiyama, Tokyo (JP); Takashi Fujiyoshi, Tokyo (JP); Kazuyuki Takata, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 164 days.

(21) Appl. No.: 15/051,177

(22) Filed: Feb. 23, 2016

(65) Prior Publication Data

US 2016/0263729 A1 Sep. 15, 2016

(30) Foreign Application Priority Data

Mar. 13, 2015 (JP) ..... 2015-051103

(51) Int. Cl.

| | |
|---|---|
| ***B28D 7/00*** | (2006.01) |
| ***B24D 7/06*** | (2006.01) |
| ***B24D 7/14*** | (2006.01) |
| ***B24D 7/18*** | (2006.01) |

(52) U.S. Cl.

CPC ..... *B24D 7/06* (2013.01); *B24D 7/14* (2013.01); *B24D 7/18* (2013.01)

(58) Field of Classification Search

CPC . B24D 1/041; B24D 7/06; B24D 7/14; B24D 7/18; B24D 11/04; B24D 18/0045; B24D 99/005

See application file for complete search history.

(56) References Cited

U.S. PATENT DOCUMENTS

| | | | | |
|---|---|---|---|---|
| 3,028,710 | A * | 4/1962 | Pratt | B24D 5/123 125/15 |
| 6,196,911 | B1 * | 3/2001 | Preston | B24D 7/06 451/527 |
| 7,677,955 | B2 * | 3/2010 | Kajiyama | B24B 1/00 451/11 |
| 9,764,442 | B2 * | 9/2017 | Suh | B24B 27/00 |
| 2001/0011004 | A1 * | 8/2001 | Yamaguchi | B24B 7/228 451/548 |
| 2002/0077054 | A1 * | 6/2002 | Sung | B01J 3/062 451/540 |

(Continued)

FOREIGN PATENT DOCUMENTS

| | | |
|---|---|---|
| JP | 2000-288881 | 10/2000 |

*Primary Examiner* — Timothy V Eley

(74) *Attorney, Agent, or Firm* — Greer Burns & Crain Ltd.

(57) ABSTRACT

A grinding wheel used for grinding of a work piece is provided. The grinding wheel includes a circular disc-shaped base having a fixed end surface in contact with a mount of grinding apparatus and a free end surface on the opposite side to the fixed end surface, and plural abrasive stone chips arranged in a ring manner on the free end surface of the base. The abrasive stone chips are each formed into a block shape having a surface in which two or more kinds of plate-shaped abrasive stone members containing abrasive grains and a binder are exposed to the outside by overlapping the two or more kinds of abrasive stone members. The surfaces exposed to the outside in the abrasive stone chips serve as grinding processing surfaces that get contact with the work piece.

6 Claims, 5 Drawing Sheets

(56) References Cited

U.S. PATENT DOCUMENTS

| | | | | |
|---|---|---|---|---|
| 2003/0054746 | A1* | 3/2003 | Nussbaumer | B24D 7/06 451/548 |
| 2003/0084894 | A1* | 5/2003 | Sung | B01J 3/062 125/12 |
| 2006/0009134 | A1* | 1/2006 | Katayama | B24B 9/065 451/41 |
| 2008/0202488 | A1* | 8/2008 | Kim | B24D 5/123 125/15 |
| 2009/0094902 | A1* | 4/2009 | Hou | B24D 7/066 51/307 |
| 2010/0035530 | A1* | 2/2010 | Gosamo | B24D 3/06 451/548 |
| 2012/0288677 | A1* | 11/2012 | Ishizu | B24D 7/06 428/141 |
| 2014/0051340 | A1* | 2/2014 | Gosamo | B24D 7/06 451/548 |
| 2016/0136773 | A1* | 5/2016 | Suh | B22F 3/115 451/540 |

* cited by examiner

GRINDING WHEEL

BACKGROUND OF THE INVENTION

Field of the Invention

The present invention relates to a grinding wheel used when a plate-shaped work piece is ground.

Description of the Related Art

In recent years, it has been required to process a wafer composed of a material such as silicon into a thin shape in order to realize size reduction and weight reduction of device chips. The wafer is thinned by grinding its back surface side after devices such as ICs and LSIs are formed in the respective regions marked out by planned dividing lines (streets) on the front surface for example.

When a plate-shaped work piece typified by a wafer is ground, grinding apparatus including a chuck table that holds the wafer and a grinding wheel that is disposed above the chuck table and has a lower surface to which abrasive stones containing abrasive grains are fixed is used for example (refer to Japanese Patent Laid-Open No. 2000-288881 for example). After the work piece is held on the chuck table, while this chuck table and the grinding wheel are each rotated, the grinding wheel is lowered and the abrasive stones are pressed against the work piece, which can grind the work piece.

SUMMARY OF THE INVENTION

When the work piece is ground by using the above-described grinding wheel, holes (chip pockets) serving as escape places for grinding waste generated by the grinding are formed in the contact surfaces of the abrasive stones in contact with the work piece. The grinding waste are discharged through these chip pockets and thereby the grinding performance of the grinding wheel is properly kept. However, in some cases, it is impossible to form the chip pockets stably and continuously depending on the specifications of the abrasive stones. In this case, the grinding performance deteriorates along with the progression of the grinding and it becomes easy for a crack to be formed in the ground surface of the work piece.

Therefore, an object of the present invention is to provide a grinding wheel whose grinding performance can be easily kept.

In accordance with an aspect of the present invention, there is provided a grinding wheel including a circular disc-shaped base having a fixed end surface in contact with a mount of grinding apparatus and a free end surface on an opposite side to the fixed end surface, and a plurality of abrasive stone chips arranged in a ring manner on the free end surface of the base. The abrasive stone chips are each formed into a block shape having a surface in which two or more kinds of plate-shaped abrasive stone members containing abrasive grains and a binder are exposed to the outside by overlapping the two or more kinds of abrasive stone members. The surfaces of the abrasive stone chips serve as grinding processing surfaces that get contact with a work piece.

In the one aspect of the present invention, the material of the binder may be any of a metal, a ceramic material, and a resin. Furthermore, in the one aspect of the present invention, it is preferable that the abrasive stone chips be formed by using the two or more kinds of abrasive stone members that are different in at least any of the grain size of the abrasive grain, the blending ratio of the abrasive grain, the material of the binder, the grade, and the porosity.

The grinding wheel according to the one aspect of the present invention includes plural abrasive stone chips each formed into a block shape by overlapping the two or more kinds of plate-shaped abrasive stone members containing the abrasive grains and the binder, and the surfaces in which the two or more kinds of abrasive stone members are exposed to the outside in the abrasive stone chips serve as the grinding processing surfaces that get contact with the work piece. Therefore, when the work piece is ground by this grinding wheel, recesses corresponding to the layered structure of the abrasive stone members are formed in the grinding processing surfaces of the abrasive stone chips. These recesses play a role similar to that of the chip pocket. That is, grinding waste generated by the grinding are discharged to the outside through the recesses formed in the grinding processing surfaces of the abrasive stone chips. As just described, in the grinding wheel according to the one aspect of the present invention, the recesses that play a role similar to that of the chip pocket can be formed stably and continuously and thus it is easy to keep the grinding performance.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
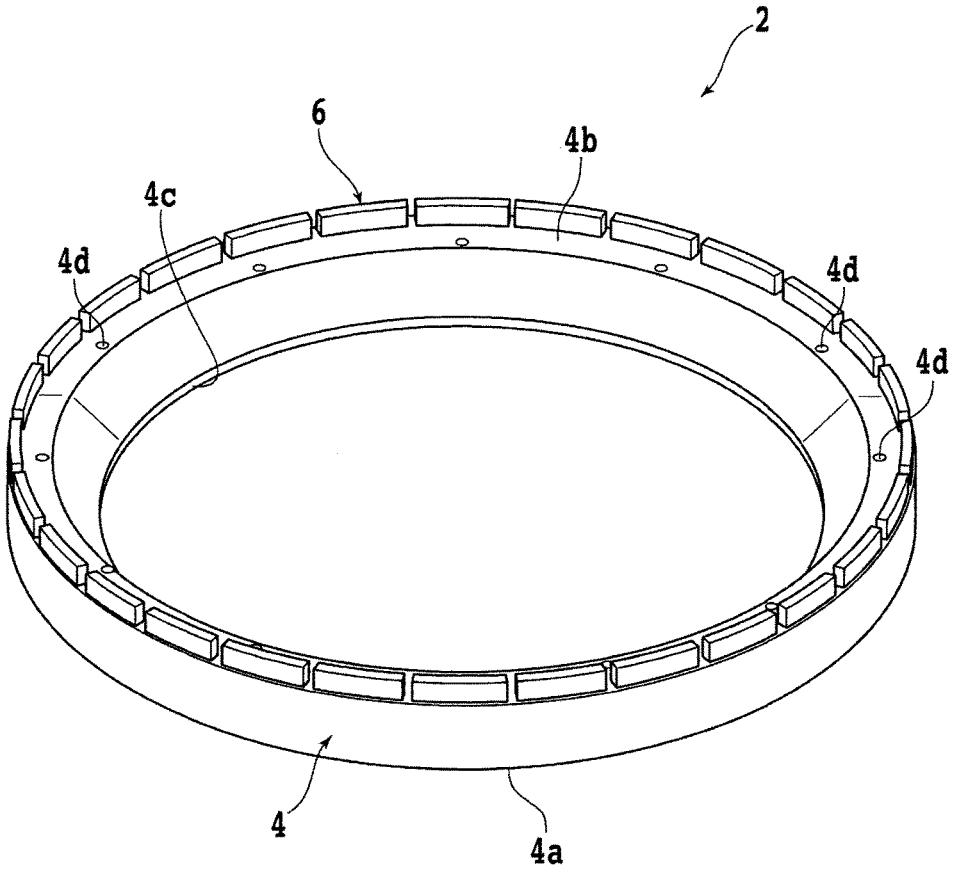
FIG. 1 is a perspective view schematically showing the structure of a grinding wheel.

An embodiment of the present invention will be described with reference to the accompanying drawings. FIG. 1 is a perspective view schematically showing the structure of a grinding wheel. As shown in FIG. 1, a grinding wheel 2 according to the present embodiment includes a base 4 that is composed of stainless steel, aluminum, or the like and has a circular disc shape (circular ring shape). The base 4 has a first surface 4*a* and a second surface 4*b* parallel to each other and an opening 4*c* that penetrates the base 4 from the first surface 4*a* to the second surface 4*b* and has a substantially circular shape is formed at the center of the base 4. On the second surface 4*b* of the base 4, plural abrasive stone chips 6 are arranged in a ring manner. Furthermore, in the second surface 4*b* of the base 4, feed ports 4*d* to feed a grinding liquid such as purified water to the abrasive stone chips 6 and a work piece (not shown) are formed.

For example, grinding processing of a work piece (not shown) can be carried out by rotating the grinding wheel 2 and pressing the abrasive stone chips 6 against the ground surface of the work piece while feeding the grinding liquid from the feed ports 4*d*. Typical examples of the work piece are a semiconductor wafer, a resin substrate, and a ceramic substrate. However, another plate-shaped object may be employed as the work piece.

When the grinding wheel 2 formed as above is mounted on grinding apparatus (not shown), the side of the first surface 4*a* of the base 4 is fixed to a mount (not shown) of the grinding apparatus. That is, the first surface 4*a* of the base 4 serves as a fixed end surface in contact with the mount of the grinding apparatus. On the other hand, the second surface 4*b* on the opposite side serves as a free end surface that is not fixed to the grinding apparatus.

Figure 2:
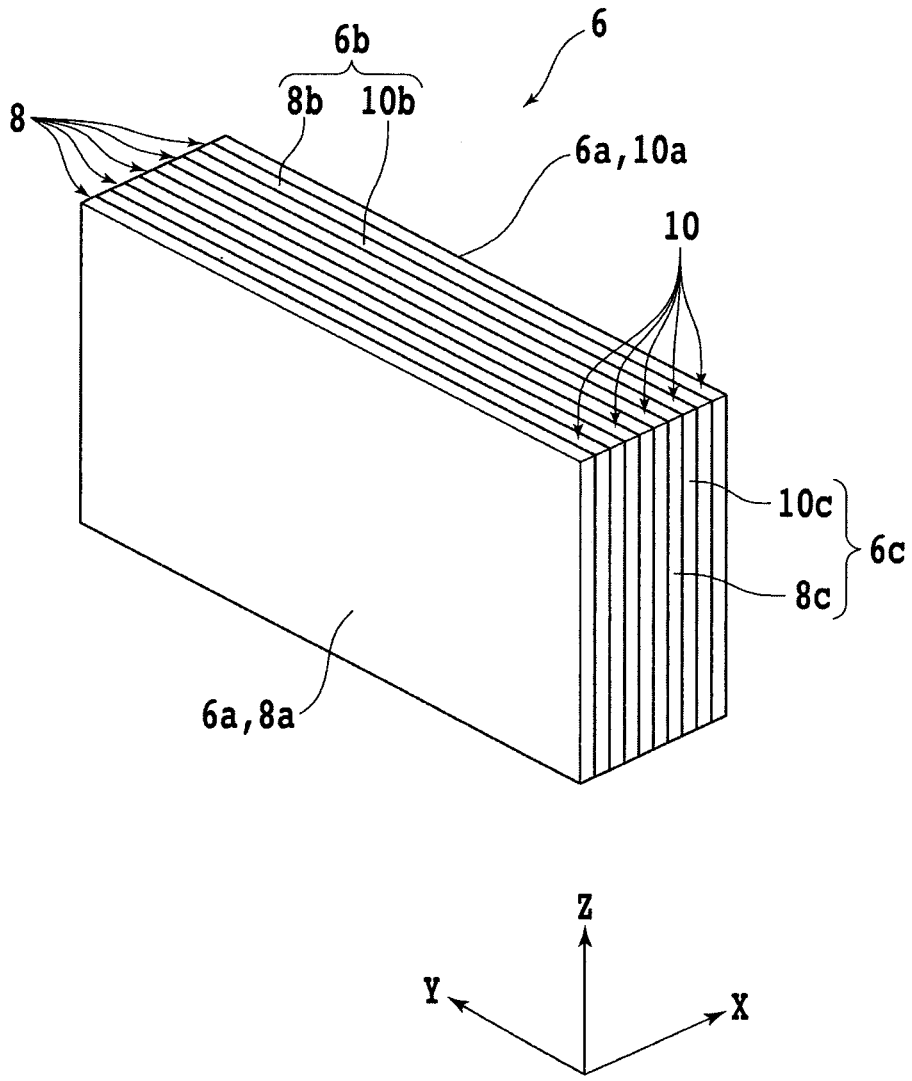
FIG. 2 is a perspective view schematically showing the structure of an abrasive stone chip.

FIG. 2 is a perspective view schematically showing the structure of the abrasive stone chip 6. As shown in FIG. 2, the abrasive stone chip 6 is formed into a rectangular parallelepiped shape by alternately overlapping plate-shaped abrasive stone members 8 and 10. The abrasive stone members 8 and 10 are formed by mixing abrasive grains of diamond, CBN, or the like in a binder such as a metal, a ceramic material, or a resin for example. However, the binder and the abrasive grain are not limited and can be selected according to the specifications of the abrasive stone chip 6.

Figure 3A:
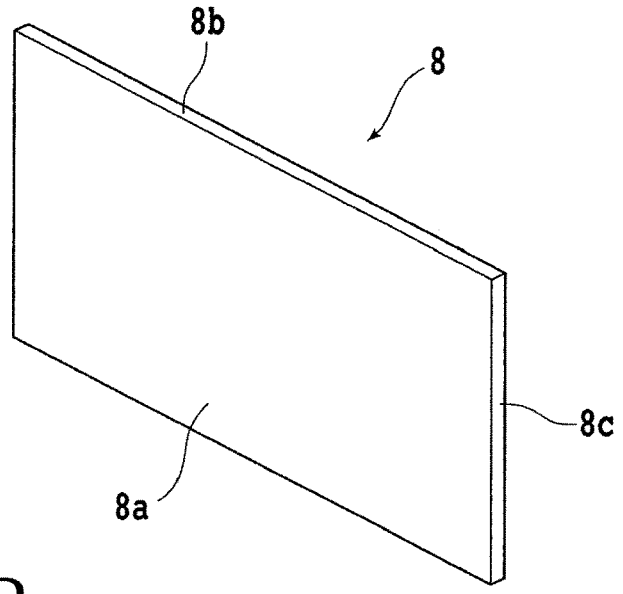
FIG. 3A and FIG. 3B are perspective views schematically showing abrasive stone members.
Figure 3B:
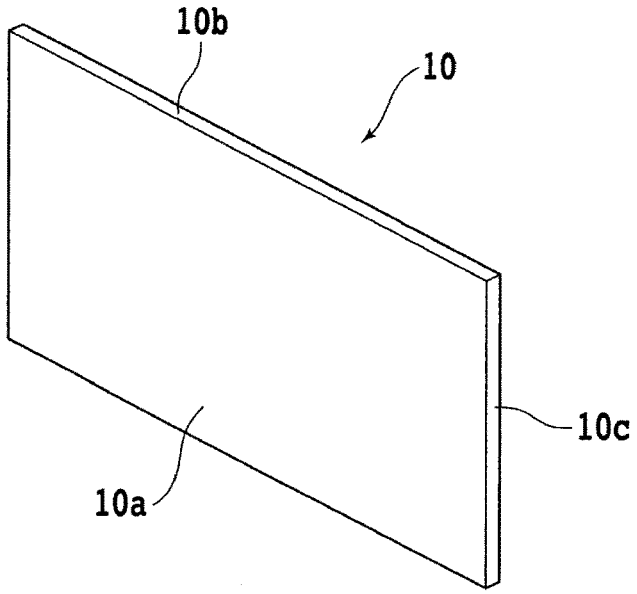

FIG. 3A is a perspective view schematically showing the abrasive stone member 8 and FIG. 3B is a perspective view schematically showing the abrasive stone member 10. As shown in FIG. 3A, the abrasive stone member 8 has a pair of first surfaces 8*a* substantially parallel to each other, a pair of second surfaces 8*b* perpendicular to the first surfaces 8*a*, and a pair of third surfaces 8*c* perpendicular to the first surfaces 8*a* and the second surfaces 8*b*. Furthermore, as shown in FIG. 3B, the abrasive stone member 10 has a pair of first surfaces 10*a* substantially parallel to each other, a pair of second surfaces 10*b* perpendicular to the first surfaces 10*a*, and a pair of third surfaces 10*c* perpendicular to the first surfaces 10*a* and the second surfaces 10*b*.

The abrasive stone member 8 and the abrasive stone member 10 are different in the grain size of the abrasive grain, the blending ratio of the abrasive grain, the material of the abrasive grain, the material of the binder, the grade, the porosity, etc. for example and exhibit different grinding properties. These abrasive stone members 8 and 10 are overlapped in such a manner that the first surface 8*a* of the abrasive stone member 8 and the first surface 10*a* of the abrasive stone member 10 are in tight contact with each other for example, to become the abrasive stone chip 6 having a rectangular parallelepiped shape. That is, the abrasive stone chip 6 according to the present embodiment is formed into a rectangular parallelepiped shape by stacking two kinds of abrasive stone members 8 and 10 having different grinding properties. Although two kinds of abrasive stone members 8 and 10 are alternately overlapped to form the abrasive stone chip 6 in the present embodiment, three or more kinds of abrasive stone members may be overlapped in arbitrary order. Furthermore, although ten layers of abrasive stone members 8 and 10 in total are used to form the abrasive stone chip 6 in the present embodiment, the numbers, size, and so forth of the abrasive stone members 8 and 10 are arbitrary.

As shown in FIG. 2, in this abrasive stone chip 6, only the first surfaces 8*a* and 10*a* located on the outermost side among the first surfaces 8*a* and 10*a* of the abrasive stone members 8 and 10 are exposed. The exposed first surfaces 8*a* and 10*a* serve as a pair of first surfaces 6*a* of the abrasive stone chip 6. On the other hand, the second surfaces 8*b* and 10*b* of the abrasive stone members 8 and 10 are all exposed and serve as a pair of second surfaces 6*b* perpendicular to the first surfaces 6*a* of the abrasive stone chip 6. That is, the second surfaces 6*b* of the abrasive stone chip 6 have a stripe-like pattern in which the second surfaces 8*b* of the abrasive stone members 8 and the second surfaces 10*b* of the abrasive stone members 10 are alternately disposed. Similarly, the third surfaces 8*c* and 10*c* of the abrasive stone members 8 and 10 are also all exposed and serve as third surfaces 6*c* perpendicular to the first surfaces 6*a* and the second surfaces 6*b* of the abrasive stone chip 6. That is, the third surfaces 6*c* of the abrasive stone chip 6 have a stripe-like pattern in which the third surfaces 8*c* of the abrasive stone members 8 and the third surfaces 10*c* of the abrasive stone members 10 are alternately disposed.

Figure 4:
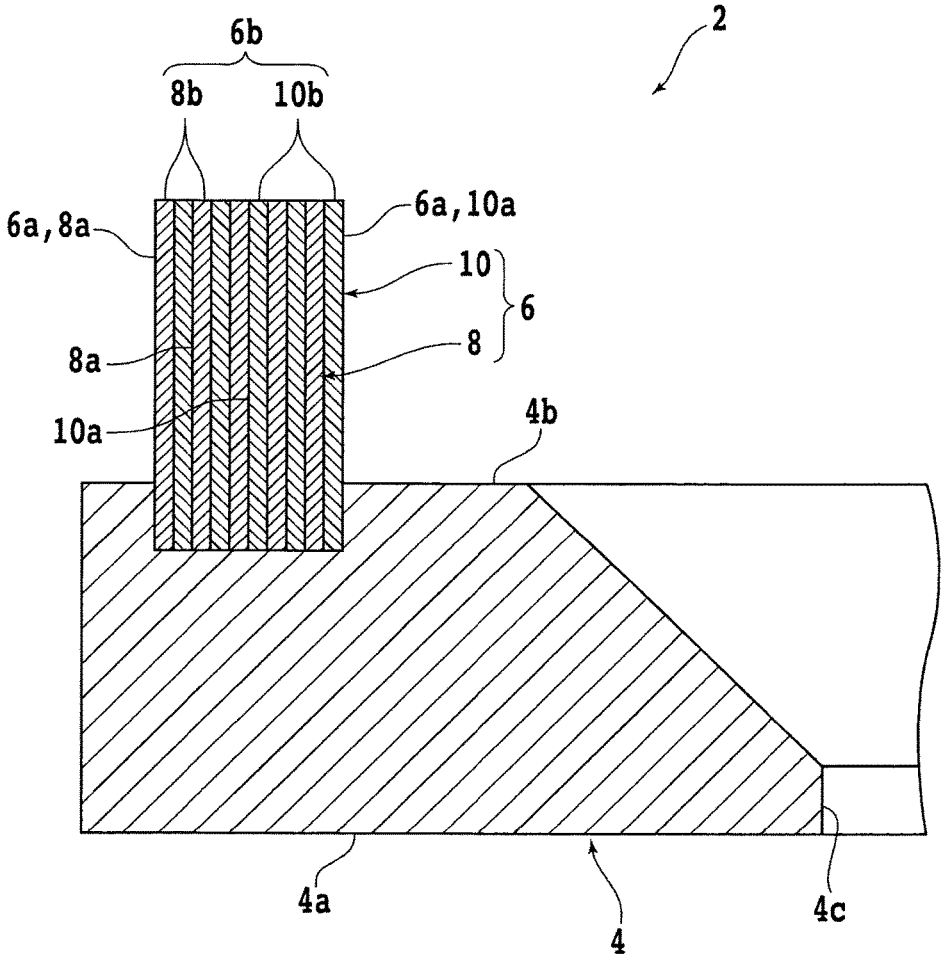
FIG. 4 is a sectional view schematically showing the structure of the grinding wheel.

The abrasive stone chip 6 formed in this manner is fixed to the second surface (free end surface) 4*b* of the base 4 in such a manner that the second surface 6*b* (or third surface 6*c*) serves as a grinding processing surface that gets contact with the work piece. FIG. 4 is a sectional view schematically showing the structure of the grinding wheel 2. As shown in FIG. 4, one side of the pair of second surfaces 6*b* of the abrasive stone chip 6 is fixed to the second surface 4*b* of the base 4 and the other side of the pair of second surfaces 6*b* is exposed. This exposed second surface 6*b* serves as the grinding processing surface that gets contact with the work piece. The abrasive stone chip 6 is so fixed that the second surfaces 6*b* are substantially parallel to the second surface 4*b* of the base 4.

As described above, the grinding wheel 2 according to the present embodiment includes the plural abrasive stone chips 6 formed into a rectangular parallelepiped shape by stacking two kinds of plate-shaped abrasive stone members 8 and 10 containing the abrasive grains and the binder, and the second surfaces 6*b* of the abrasive stone chips 6, in which the abrasive stone members 8 and 10 are both exposed to the outside, serve as the grinding processing surfaces that get contact with a work piece. Therefore, when the work piece is ground by this grinding wheel 2, a stripe-like recess and projection structure (recesses) corresponding to the layered structure of the abrasive stone members 8 and 10 is formed in the grinding processing surfaces of the abrasive stone chips 6. The recesses in this recess and projection structure play a role similar to that of the chip pocket. That is, grinding waste generated by the grinding are discharged to the outside through the recesses formed in the grinding processing surfaces of the abrasive stone chips 6. As above, in the grinding wheel 2 according to the present embodiment, the recesses that play a role similar to that of the chip pocket can be formed stably and continuously and thus it is easy to keep the grinding performance.

(Working Example)

In the present working example, a more specific example of the grinding wheel according to the above-described embodiment will be described. However, the present invention is not limited by the description of the present working example.

In the present working example, abrasive stone chips were formed by alternately overlapping abrasive stone members (A) obtained by mixing 25-volume % abrasive grains composed of diamond in a binder composed of a resin and abrasive stone members (B) obtained by mixing 12.5-volume % abrasive grains composed of diamond in the binder composed of the resin. The size of each abrasive stone member was set to about 5 mm×20 mm×0.125 mm. Furthermore, each abrasive stone chip was formed by overlapping eight abrasive stone members (A) and eight abrasive stone members (B) (sixteen layers in total). That is, the size of the abrasive stone chip was about 5 mm×20 mm×2 mm. The material, size, number of stacked layers, and so forth of the abrasive stone members can be arbitrarily changed according to the specifications of the abrasive stone chip.

The outline of a manufacturing step of the abrasive stone chips will be described. First, a thermosetting resin in powder form and abrasive grains are mixed and put in a mold for forming abrasive stone members. Next, this mixture material is pressed (cold working) to obtain sheet-shaped powder compacts. Thereafter, the formed powder compacts are overlapped and pressed (hot working) at a proper temperature. Thereby, the abrasive stone chips each composed of a sintered body obtained by making the plural layers (sixteen layers) monolithic are obtained.

The plural abrasive stone chips obtained in the above-described manner are fixed to a base by using an adhesive or the like in such a manner that surfaces in which the two kinds of abrasive stone members of the abrasive stone chip are both exposed to the outside serve as grinding processing surfaces that get contact with a work piece. When a silicon wafer was ground by the grinding wheel formed in this manner, recesses were formed in the grinding processing surfaces and the grinding performance could be properly kept.

The present invention is not limited to the description of the above embodiment and working example and can be carried out with various changes. For example, in the above-described working example, the abrasive stone chips are formed by overlapping abrasive stone members (A) and abrasive stone members (B) that are different in the blending ratio (content) of the abrasive grain. However, the present invention is not limited to this form. It is also possible to form the abrasive stone chips by using abrasive stone members different in the grain size of the abrasive grain, abrasive stone members different in the material of the binder, abrasive stone members different in the grade, abrasive stone members different in the porosity, or the like.

Furthermore, in the above-described embodiment, the rectangular parallelepiped-shaped abrasive stone chip 6 having a predetermined layered structure is described. However, the abrasive stone chip according to the present invention can be formed into an arbitrary structure (shape). It suffices for the abrasive stone chip according to the present invention to be formed into a block shape having a surface in which at least two kinds of abrasive stone members are exposed to the outside.

Figure 5A:
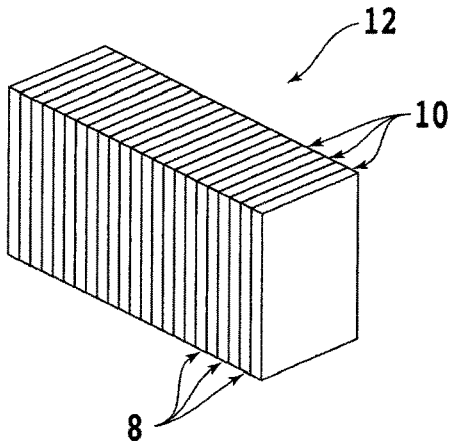
FIG. 5A is a perspective view schematically showing the structure of an abrasive stone chip according to a first modification example.
Figure 5B:
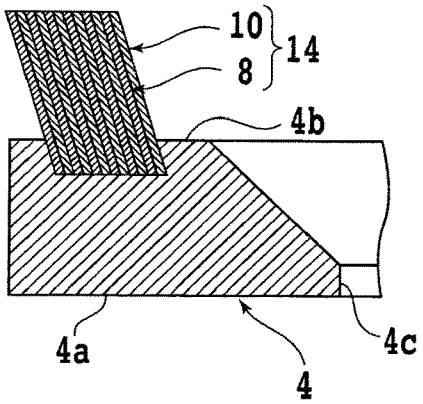
FIG. 5B is a perspective view schematically showing the structure of an abrasive stone chip according to a second modification example.
Figure 5C:
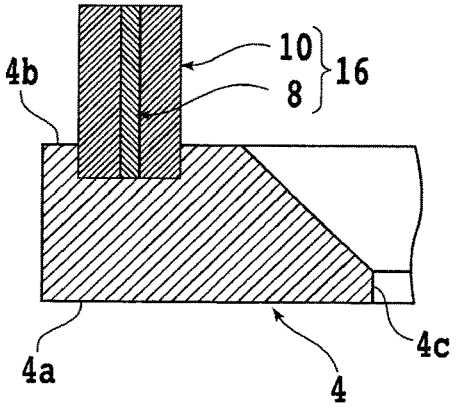
FIG. 5C is a perspective view schematically showing the structure of an abrasive stone chip according to a third modification example.

FIG. 5A is a perspective view schematically showing the structure of an abrasive stone chip according to a first modification example. FIG. 5B is a sectional view schematically showing the structure of an abrasive stone chip according to a second modification example. FIG. 5C is a sectional view schematically showing the structure of an abrasive stone chip according to a third modification example. As shown in FIG. 5A, in an abrasive stone chip 12 according to the first modification example, the layer-stacking direction of the abrasive stone members 8 and 10 is different from the abrasive stone chip 6 according to the above-described embodiment. Specifically, in the abrasive stone chip 6 according to the above-described embodiment, the abrasive stone members 8 and 10 are overlapped along a direction parallel to the radial direction of the base 4 (FIG. 4 and so forth). However, in the abrasive stone chip 12 according to the first modification example, the abrasive stone members 8 and 10 are overlapped along a direction perpendicular to the radial direction of the base 4. On the other hand, as shown in FIG. 5B, in an abrasive stone chip 14 according to the second modification example, the abrasive stone members 8 and 10 are overlapped in an inclined state. Specifically, the abrasive stone members 8 and 10 are inclined with respect to the first surface 4*a* and the second surface 4*b* of the base 4. Furthermore, as shown in FIG. 5C, in an abrasive stone chip 16 according to the third modification example, the thickness of the abrasive stone member 8 is different from the thickness of the abrasive stone member 10. Specifically, one thin abrasive stone member 8 is sandwiched by two thick abrasive stone members 10.

Furthermore, in the above-described embodiment, the abrasive stone chip 6 formed of different two kinds of abrasive stone members 8 and 10 is described. However, it is also possible to form an abrasive stone chip by overlapping completely the same abrasive stone members. In this case, recesses are readily formed near the interface between adjacent abrasive stone members and the grinding performance can be properly kept.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel comprising:

a circular disc-shaped base having a fixed disc-shaped surface for contact with a mount of a grinding apparatus and an exposed disc-shaped surface on an opposite surface to the fixed disc-shaped surface; and a plurality of parallelopiped-shaped abrasive stone chips each having first and second opposing planar sides and first, second, third and fourth edges surrounding the first and second planar sides, the plurality of parallelopiped-shaped abrasive stone chips being oriented with the first and second opposing planar sides perpendicular to the exposed disc-shaped surface and arranged in a ring manner on the exposed disc-shaped surface of the base, wherein the plurality of parallelopiped-shaped abrasive stone chips include two or more alternating kinds of plate-shaped abrasive stone members containing different compositions of abrasive grains and a binder, and a selected edge of the abrasive stone chips serve as a grinding processing surface when in contact with a work piece.

2. The grinding wheel according to claim 1, wherein material of the binder is any of a metal, a ceramic material, and a resin.

3. The grinding wheel according to claim 1, wherein the different compositions differ in grain size of the abrasive grains.

4. The grinding wheel according to claim 1, wherein the different compositions differ in a blending ratio of the abrasive grains.

5. The grinding wheel according to claim 1, wherein the different compositions differ in material of the binder.

6. The grinding wheel according to claim 1, wherein the different compositions differ in porosity.

* * * * *